US008037907B2

(12) United States Patent
Haas et al.

(10) Patent No.: US 8,037,907 B2
(45) Date of Patent: Oct. 18, 2011

(54) METHOD AND DEVICE FOR THE CONTROLLED FOAMING OF A PRODUCT INTRODUCED IN BOTTLES OR SIMILAR CONTAINERS

(75) Inventors: Gernod Haas, Eisenberg (DE); Olaf Muszinski, Kelkheim (DE)

(73) Assignee: KHS AG, Dortmund (DE)

( * ) Notice: Subject to any disclaimer, the term of this patent is extended or adjusted under 35 U.S.C. 154(b) by 526 days.

(21) Appl. No.: 12/269,467

(22) Filed: Nov. 12, 2008

(65) Prior Publication Data

US 2009/0283177 A1 Nov. 19, 2009

Related U.S. Application Data

(63) Continuation-in-part of application No. PCT/EP2007/004216, filed on May 11, 2007.

(30) Foreign Application Priority Data

May 13, 2006 (DE) ..... 10 2006 022 464

(51) Int. Cl.
*B65B 1/20* (2006.01)

(52) U.S. Cl. ..... 141/11; 141/82

(58) Field of Classification Search ..... 141/11, 141/5, 63, 82, 92, 144
See application file for complete search history.

(56) References Cited

U.S. PATENT DOCUMENTS

| | | | | |
|---|---|---|---|---|
| 3,548,891 | A * | 12/1970 | Hull | 141/7 |
| 3,710,538 | A * | 1/1973 | Lowy et al. | 53/428 |
| 4,514,953 | A | 5/1985 | Patzwahl | |
| 5,082,033 | A * | 1/1992 | Weiss | 141/39 |
| 5,168,905 | A * | 12/1992 | Phallen | 141/1 |

FOREIGN PATENT DOCUMENTS

| | | |
|---|---|---|
| CA | 1 195 303 | 10/1985 |
| DE | 1 979 515 | 2/1968 |
| DE | 16 32 034 | 3/1972 |
| DE | 40 30 081 | 3/1992 |
| DE | 41 35 438 | 4/1993 |
| DE | 196 13 142 | 10/1996 |
| EP | 0 479 030 | 4/1992 |
| GB | 1 395 607 | 5/1975 |

OTHER PUBLICATIONS

International Search Report PCT/EP2007/004216 and English translation thereof.
International Preliminary Report on Patentability PCT/EP2007/004216 and English translation thereof.

* cited by examiner

*Primary Examiner* — Davis Hwu
(74) *Attorney, Agent, or Firm* — Nils H. Ljungman & Associates

(57) ABSTRACT

A method and device for the controlled foaming of a product introduced in bottles or similar containers.

20 Claims, 3 Drawing Sheets

METHOD AND DEVICE FOR THE CONTROLLED FOAMING OF A PRODUCT INTRODUCED IN BOTTLES OR SIMILAR CONTAINERS

CONTINUING APPLICATION DATA

This application is a Continuation-In-Part application of International Patent Application No. PCT/EP2007/004216, filed on May 11, 2007, which claims priority from Federal Republic of Germany Patent Application No. 10 2006 022 464.7, filed on May 13, 2006. International Patent Application No. PCT/EP2007/004216 was pending as of the filing date of this application. The United States was an elected state in International Patent Application No. PCT/EP2007/004216.

BACKGROUND

1. Technical Field

This present application relates to a method and device for the controlled foaming of a product introduced in bottles or similar containers.

2. Background Information

Background information is for informational purposes only and does not necessarily admit that subsequently mentioned information and publications are prior art.

In the beverage industry, bottles, kegs or similar containers that have been filled in a filling machine with a bulk material, usually with a liquid that comprises carbon dioxide or an otherwise effervescent liquid, must or should be pressurized with a liquid foaming medium under pressure. The objective is to foam the liquid in the individual container to thereby displace any air or atmospheric oxygen that is present in the container above the level of the liquid and to restrict or minimize any adverse effect of oxygen on the liquid or its shelf life and taste. The liquid foaming medium used can thereby be water, for example, and usually heated water, for example. For the introduction of the foaming medium, at least one injector nozzle is used to which the foaming medium is fed under pressure and underneath which the containers filled with the liquid being bottled are carried on a conveyor line between a filling machine and a capping or closing machine which is downstream of this bottling machine in the production line. The introduction or injection of the foaming fluid must or should be done with due consideration given to product-specific parameters and as a function of the output of the production line, i.e. as a function of the number of containers treated with the foaming medium per unit of time, so that on one hand a sufficiently strong foaming is achieved, and on the other hand, gushing is restricted or minimized. It is also desired to perform the introduction of the foaming medium in a sterile environment.

The amount of energy introduced into the container for the foaming is a function of a number of different parameters such as, for example, the temperature and the quantity of the foaming medium introduced into the individual container as well as the injection pressure with which this medium is injected into the container. The duration of the injection must or should also be taken into consideration.

In methods and devices for foaming, the injection pressure and the volume flow of the foaming medium are fixed for the respective liquid being bottled and for a specified production rate of the filling machine and/or of the production line.

Fluctuations in the production rate of the production line, however, therefore result in an unsatisfactory foaming of the liquid in the containers, i.e. either insufficient foaming or gushing.

Some devices are used for the controlled feed of an inert gas, for example $CO_2$ gas, to beverage cans during the closing process to improve the shelf life of the product by displacing the air and atmospheric oxygen above the level of the liquid. The quantity of gas injected is regulated as a function of the speed with which the cans are closed.

Some devices and methods with a variable injection height or pressure in the injector nozzle are used to achieve an optimum foaming result. Some use a piston pump arrangement activated by compressed air or a pump driven by an electric motor and a dosing valve control system to optimize the foaming. Some devices utilize a piston system with a pressure booster.

With these systems, however, which generally function well, one remaining problem is that primarily on high-capacity or high-speed filling and closing machines, a relatively large quantity of fluid should be injected to essentially ensure or promote complete foaming. It is also not possible to react optimally, suitably and quickly to changes in the speed of the production process over its entire range, from startup conditions to maximum production.

OBJECT OR OBJECTS

The object of the present application is therefore to create a variable method for high-capacity or high-speed bottling plants with which an improved foaming of a liquid dispensed into bottles or similar containers can be achieved.

SUMMARY

The present application teaches that this object can be accomplished by the method for the controlled foaming of a liquid introduced into bottles or similar containers, using at least one injector nozzle, via which a liquid foaming medium is injected under pressure in the containers passing the nozzle. The foaming medium is injected at a pressure of two to sixteen bar and the injection pressure is increased with an increasing number of containers passing the nozzle per unit of time, i.e. as the production rate is increased. Parallel or virtually parallel to a pump, a bypass line is provided. The pump is used with the frequency-controlled drive for the regulation of the injection pressure and the bypass line essentially guarantees or promotes a minimum flow through the pump. A device for the performance of the method is the object of a device for the controlled foaming of a liquid introduced into bottles or similar containers with at least one injector nozzle, the which a liquid foaming medium is injected under pressure into the containers passing this nozzle. A control device, which increases the injection pressure with an increase in the number of the containers that pass the nozzle per unit of time, i.e. as the production rate increases, seats the quantity of the treatment medium injected into the individual containers less than 0.05 milliliters. The pump is equipped with a frequency-controlled drive for the regulation of the injection pressure.

In accordance with one of the basic teachings of the present application, of these parameters essentially only the injection pressure is suitable for a regulation of the quantity of energy injected or of the foaming process as a function of the production rate of the production line or as a function of the production rate of the filling machine and the closing or capping machine located downstream of the filling machine.

The present application further teaches, however, that a regulation of the foaming process and thereby in one possible embodiment of the injection pressure as a function of the production rate of the production line and/or of the filling machine and thus also of the number of the containers processed with the foaming medium per unit of time is essentially only possible when the injection pressure can be regulated within a broad range, for example in a range between at least one bar and eight bar, in one possible embodiment in a range between approximately one bar and sixteen bar, and possibly with a correspondingly low volume flow of the liquid foaming medium, e.g. at a volume flow of a maximum two liters per minute, often of a maximum one and a half liters per minute for the pump generating the injection pressure. The present application thereby achieves a genuine regulation of the quantity of energy injected and of the foaming process as a function of the output of the production plant. With an appropriate selection of the product-specific parameters, namely the type of liquid being filled into the containers, the filling temperature, the type of containers or bottles, etc., on the control device or on an input device provided on the control device, by means of this control device the setpoint for the injection as a function of the current production rate of the production line is determined, and in one possible embodiment, for example, by taking it from a list or table stored electronically in the memory. By measuring the injection pressure at the injector nozzle with a pressure sensor provided on the nozzle, this actual injection pressure as the measured value is compared with the setpoint and the speed and/or delivery of the pump is adjusted so that the measured value equals the setpoint.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Developments of the present application are described according to at least one possible embodiment of the present application. The present application is explained in greater detail below with reference to the accompanying figures in which.

DESCRIPTION OF EMBODIMENT OR EMBODIMENTS

Figure 1:
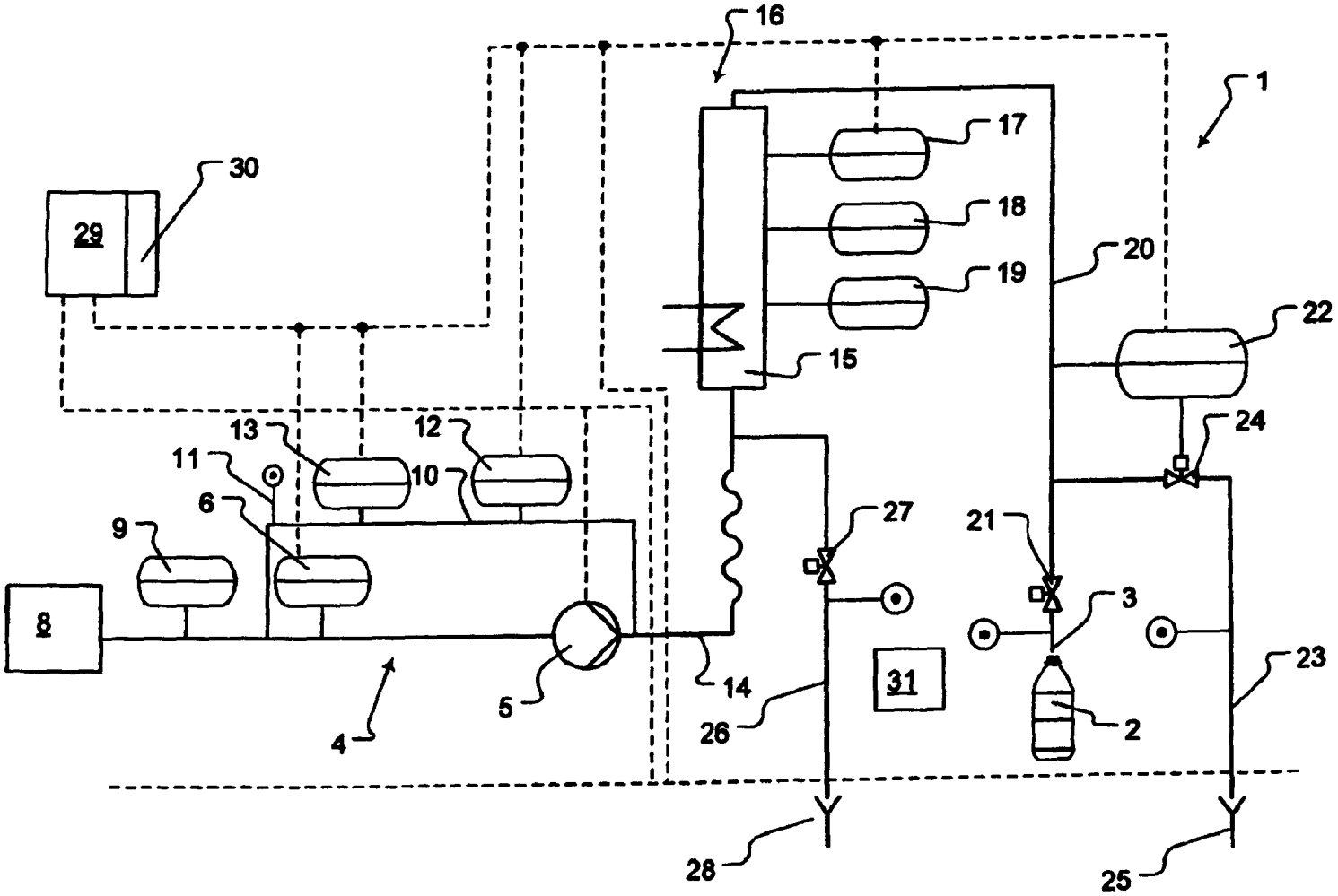
FIG. 1 shows a simplified illustration of a device for high-pressure injection.

The device designated 1 in FIG. 1 is a component of a production line for the filling of bottles 2 or similar containers with a liquid and for the closing of the filled bottles 2, and is used to foam the liquid dispensed in the bottles 2, in one possible embodiment carbonated liquids, by a controlled input of energy, so that the foam displaces air and in one possible embodiment atmospheric oxygen above the level of the liquid from the bottle 2, without any over-foaming. The energy is introduced in a controlled manner by at least one injector nozzle 3, which is provided above the path of movement of the bottles 2 which are standing upright between a filling machine (not shown) and a closing or capping machine (also not shown). For the foaming, a specified quantity of a liquid and optionally warmed medium that effects the foaming is introduced at a specified injection pressure into each of the bottles moving below the injector nozzle 3. The foaming medium can thereby be water and/or the liquid being bottled, for example.

The quantity of energy injected is composed of the kinetic energy, i.e. from the quantity and the injection pressure of the foaming media injected, and the thermal energy, i.e. the temperature of the foaming medium. To also keep the quantity of energy injected into each bottle 2 as constant as possible at different production rates of the production plant, i.e. with different numbers of the bottles 2 filled and capped per unit of time or with a different number of bottles 2 passing the injector nozzle 3 per unit of time, in the device 1, in the manner described below, at a constant or essentially constant temperature of the foaming medium, the kinetic energy of the injection is regulated by variations of the injection pressure as a function of the production rate, whereby during the operation of the device 1, the foaming medium is continuously discharged from the injector nozzle 3 in a quantity that is adjusted to the production rate of the production line and to the adjusted injection pressure from the injector nozzle 3.

In detail, the device 1 comprises, among other things, a pump circuit 4, the essential component of which is a high-pressure pump 5 with a frequency-controlled drive motor. The input of the pump 5 is in communication via a flow meter 6 and a line 7 with a source 8, which makes the liquid foaming medium available. This source 8 is, for example, the respective system for the supply of fresh water, whereby in the line 7 there are additional elements such as, for example, control and/or shutoff valves, filters, etc. The number 9 designates a temperature sensor provided in the line 7, with which the temperature of the foaming medium made available by the source 8 is determined.

In at least one possible embodiment of the present application, the frequency-controlled drive motor is connected to or comprises a frequency-controlled inverter.

In at least one possible embodiment of the present application, the control device 29 and/or a frequency-controlled inverter produces a variable frequency operating voltage, which then causes the frequency-controlled drive motor and pump 5 to run at a speed determined by the variable frequency operating voltage. For example, when the frequency produced by the control device 29 and/or frequency-controlled inverter is a higher frequency, the frequency-controlled drive motor runs faster and the pump 5 generates a higher water pressure. Likewise, when the frequency produced by the control device 29 and/or the frequency-controlled inverter is a lower frequency, the frequency-controlled drive motor runs slower and the pump 5 generates a lower water pressure.

Parallel or virtually parallel to the series arrangement comprising the pump 5 and the flow meter 6 is a bypass which is formed essentially by a line 10 which connects the output of the pump 5 with the inlet of the flow meter 6 which is located in the flow direction of the foaming medium upstream of the pump 5. In the line 10 are, among other things, a choke 11 and a pressure sensor 12 which measures the pressure at the output of the pump 5 and an additional temperature sensor 13. The flow cross section formed by this choke is selected so that even at a lower volume flow or in the absence of a volume flow, a minimum flow at the output of the pump circuit 4 is essentially guaranteed or promoted by the pump 5 which is sufficient for the lubrication and cooling of the pump 5.

The output of the pump circuit 4 is connected via a line 14 with the input of a boiler or water heater 15 which can be electrically operated, for example, is an essential component of a heating circuit 16 and to which, in the illustrated possible embodiment, a pressure sensor 17, a level sensor 18 and a temperature sensor 19, among other things, are connected. The output of the boiler 15 is connected with a line 20 with the injector nozzle 3, which can have, for example, a defined nozzle or flow section but one that can be adapted to the current product being bottled. In the line, upstream of the injector nozzle 3, there is an electrically controlled shutoff valve 21, and in the direction of flow upstream of this shutoff valve there is an additional temperature sensor 22.

Between the temperature sensor 22 and the shutoff valve 21, a bypass line 23 branches off from the line 20, in which bypass line 23 an electrically controllable shutoff valve 24 is provided and which bypass line 23 leads to a drain 25. A similar bypass line 26 in which an electrically actuated shutoff valve 27 is provided and which leads to a drain 28 branches off at the inlet of the boiler 15.

Under the control of a central control unit 29, which is fed, among other things, with the signals from the various temperature sensors and pressure sensors, the following basic modes of operation are possible:

1. Filling of the Boiler 15 with the Liquid Foaming Medium and Heating of the Foaming Medium to Operating Temperature.

To start up the device 1, the boiler 15 is first filled with the foaming medium (e.g. water) and the foaming medium is heated to a temperature that is somewhat higher than the subsequent operating or working temperature of this medium, for example for an operating or working temperature of eighty-five degrees Celsius to a temperature of ninety degrees Celsius. The boiler 15 is filled via the pump 5, which can be turned off, for example, and/or via the pump bypass 10. The heater of the boiler is activated as soon as the level meter 18 determines that the boiler has been completely filled.

2. Heating of the Line 20 and of the Bypass Lines 23 and 26.

With the pump 5 turned on, the shutoff valve 21 closed and the shutoff valve 24 open, the heated liquid foaming medium flows out of the boiler 15 via the line 20 to the bypass line 23 and from there into the drain 25. The temperature of the foaming medium is regulated to the operating temperature by means of the temperature sensors 19 and 22 (for example eighty-five degrees Celsius), and in one possible embodiment by means of a corresponding control of the heating system of the boiler 15.

3. Current Operation of the Device 1.

For the operation of the device 1, the bypass line 23 is closed with the shutoff valve 24 and the shutoff valve 21 is opened so that the foaming medium heated to operating temperature is injected at the pump pressure generated by the pump 5 into the bottles 2 that are moved past and underneath the injector nozzle 3.

4. Production Interruption.

During an interruption in production, the shutoff valve 21 is closed and the bypass line 23 is opened by means of the shutoff valve 24, so that heated foaming medium continues to flow through the line 20, thereby maintaining the desired temperature. Analogously, when the temperature measured by the temperature sensor 22 falls below a specified lower threshold, the shutoff valve 21 is closed and the bypass line 23 is opened via the shutoff valve 24, and in one possible embodiment during the interruption in production.

5. End of Production

For the emptying of the plant, and in one possible embodiment also for the emptying of the boiler 15 when production is ended, with the shutoff valve 21 closed, the bypass lines 23 and 26 are opened via the associated shutoff valves 24 and 27.

As explained above, the energy for the high-pressure injection is regulated by controlling the pressure at the output of the pump 5 and thus the injection pressure of the foaming medium at the injector nozzle 3 as a function of a setpoint which is typical for the respective liquid being bottled and appropriate to the current production rate. This product-typical setpoint is stored, for example, in the form of a data set in a memory 30 of the computer-assisted control device 29, so that the control device 29 can then regulate the pump 5 as a function of the product and production rate (containers/hour), and in one possible embodiment in consideration of a control signal that is appropriate to the capacity of the production line (bottles 2 filled and capped per unit of time) and is transmitted, for example, to the filling machine, and in consideration of the pressure applied to the injector nozzle 3 and of the determined by the pressure sensor 17, for example, in each case in the form of a measured value.

In the illustrated embodiment, the pump 5 and the pump circuit 4 are realized so that the pump pressure can be regulated in the range of between at least 2 bar and 16 bar, and in one possible embodiment with a relatively small flow in the range of approximately 0.7 through 1.5 liters per minute.

Because as the production rate of the production plant increases, the length of time each bottle 2 is located below the injector nozzle 3 and can therefore receive the amount of foaming medium injected decreases, the injection pressure is increased as the production rate of the production plant increases.

Depending on the liquid being filled into the containers, in the illustrated possible embodiment the diameter of the injector nozzle 3 is also modified, i.e. for a liquid which tends to foam easily, such as Weissbier, an injector nozzle 3 with a reduced diameter is used. Conversely, for a product or liquid which is difficult to foam, an injector nozzle 3 with a larger nozzle diameter is used.

The following table presents typical process parameters for three different products, namely in consideration of bottles 2 that have an inside diameter of twenty-two millimeters on their bottle mouth.

| Product of liquid being bottled | Energy injected in mJ | Nozzle diameter in mm | Maximum volume in ml/bottle[1] | Minimum volume in ml/bottle[2] |
|---|---|---|---|---|
| Product 1 | 1.96 | 0.20 | 0.008 | 0.002 |
| Product 2 | 6.00 | 0.35 | 0.015 | 0.050 |
| Product 3 | 12.24 | 0.50 | 0.030 | 0.009 |

[1]is thereby the maximum volume $V_{max}$ of foaming medium introduced into the respective bottle 2 and stands for a minimum production rate of approximately 1,800 bottles per hour at a pump pressure of 2.3 bar.

[2]is thereby the minimum volume $V_{min}$ of foaming medium introduced into the respective bottle 2 and stands for a maximum production rate of approximately 29,000 bottles per hour at an injection pressure of fifteen bar.

The result is therefore the operating points for the pump 5 summarized in the following table:

| Nozzle diameter mm | Pump operating point | 1,800 bottles/h | 29,000 bottles/h |
|---|---|---|---|
| 0.20 | Volume l/min | 0.7 | 1.0 |
| | Pressure in bar | 1.7 | 14.1 |
| 0.35 | Volume l/min | 0.8 | 1.2 |
| | Pressure in bar | 1.3 | 14.1 |
| 0.5 | Volume l/min | 0.7 | 1.4 |
| | Pressure in bar | 1.3 | 14.1 |

In general, it is apparent from the above tables that, among other things, regardless of the product being bottled, the ratio $V_{max}/V_{min}$ is approximately three to four, the pump pressure at a high production rate is significantly greater than eight bar and the maximum quantity $V_{max}$ of foaming medium injected even with a product that is difficult to foam and a low production rate of the production plant is significantly less than 0.05 milliliter per bottle.

The small quantity of foaming medium to be introduced into the bottles 2 also has the advantage that, among other things, when water is used as the foaming medium, no or essentially no dilution of the product occurs, and that, among other things, the consumption of foaming medium is significantly reduced.

By means of the pump bypass which is formed by the line 10, it is also possible to keep the quantity of foaming medium discharged from the injector nozzle 3 as small as desired, and to still essentially guarantee or promote a sufficient minimum delivery for the pump 5, in one possible embodiment also for the lubrication and/or cooling of the pump 5. The pump bypass also makes it possible to restrict or minimize an overshooting during the regulation of the pump pressure as a function of the production rate of the production plant, i.e. a resetting of the pump pressure can be achieved in an extremely short time, e.g., in 0.5 seconds, with often extremely small pressure fluctuations, e.g., in the range of a maximum +/−0.3 bar, and even in the event of extreme variations in the plant production capacity.

Figure 1A:
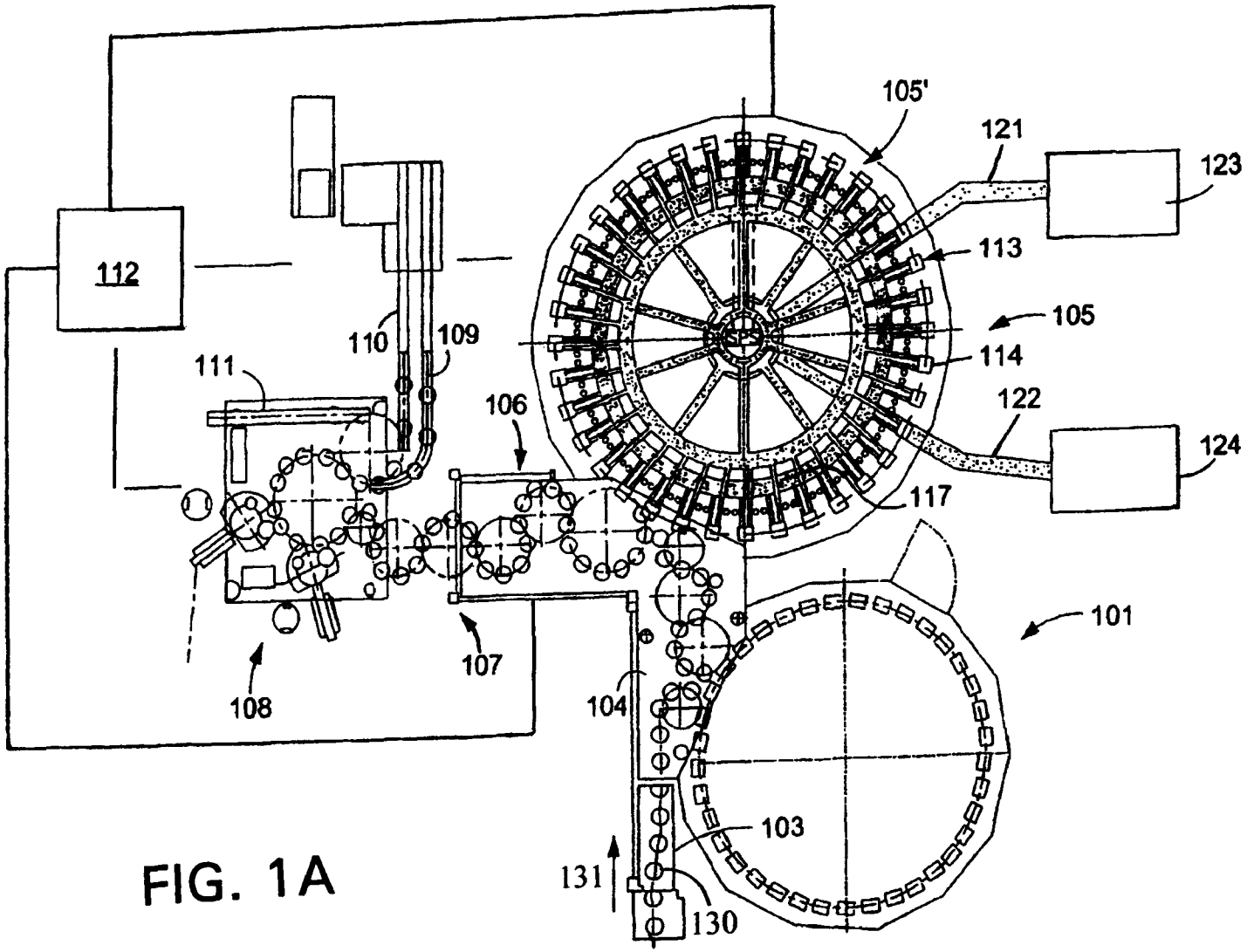
FIG. 1A shows schematically the main components of one possible embodiment example of a system for filling containers, specifically, a beverage bottling plant for filling bottles with at least one liquid effervescent beverage.

FIG. 1A shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

Figure 2:
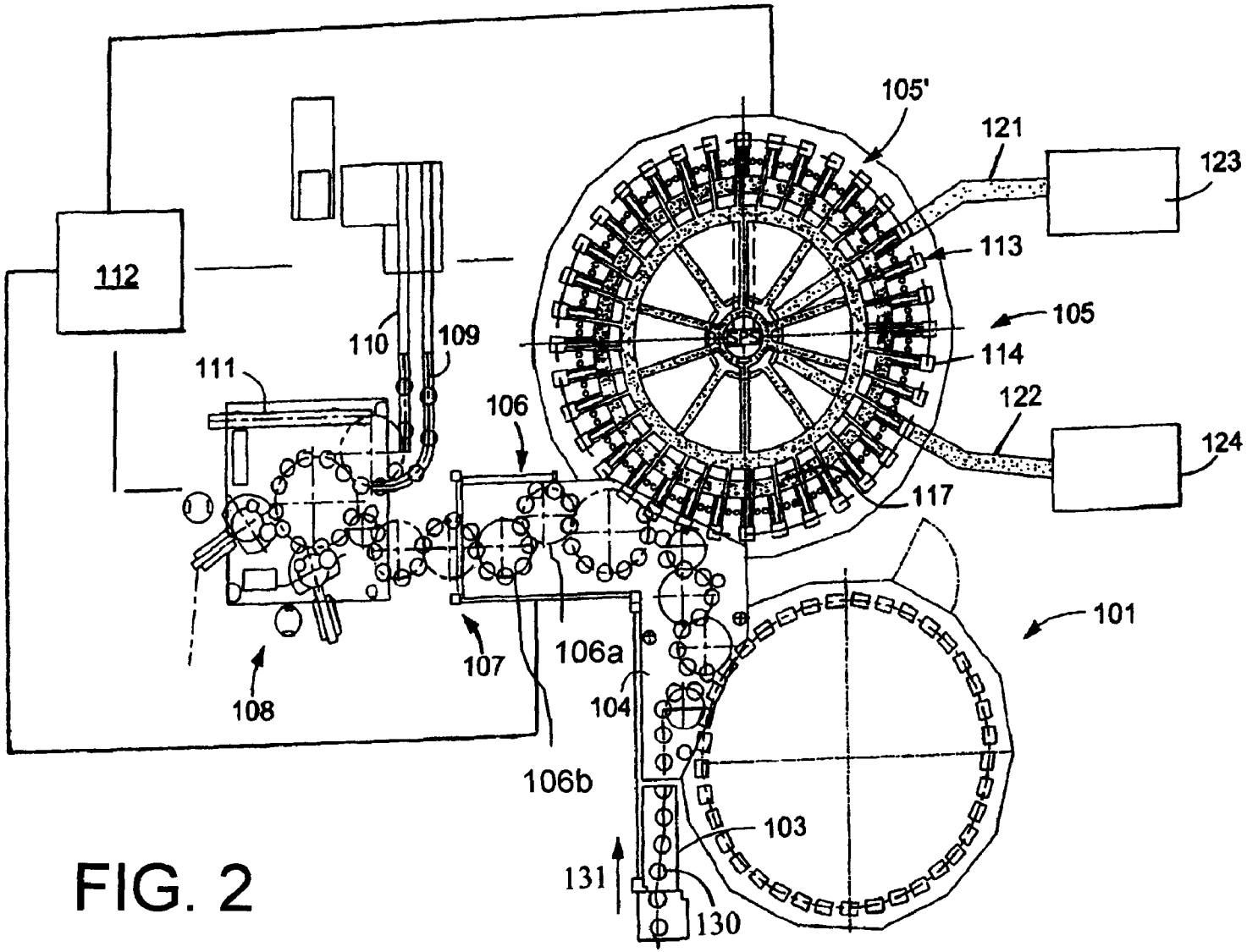
FIG. 2 shows schematically the main components of one possible embodiment example of a system for filling containers, including the foaming device of the present application.

FIG. 2 shows schematically the main components of one possible embodiment example of a system for filling containers, specifically, a beverage bottling plant for filling bottles 130 with at least one liquid beverage, similar to that seen in FIG. 1A. In FIG. 2, the closing arrangement or closing station 106 further comprising a foaming device 106*a*, which is the foaming device of the present application. The closing arrangement or closing station 106 also comprises a closing or capping machine 106*b*.

The present application was described above on the basis of one possible embodiment. It goes without saying that numerous modifications and variations are possible without thereby going beyond the teaching of the present application.

For example, it is possible, when there is a sensor downstream of the injector nozzle 3 in the direction of transport of the bottles 2, e.g. with an optoelectrical sensor 31, e.g. in the form of a camera, to measure the foaming as a measured value of the foaming produced by the high pressure injection and to compare it with a specified foaming, so that action can then be taken to regulate or control the relevant parameters of the injection process, in one possible embodiment the injection pressure, etc.

In the above explanation, it was assumed that the injection pressure is regulated by the pressure of the pump 5. Other measures are also conceivable, for example a regulation by a controlled opening and closing of a bypass line, for example of the bypass line 26 and/or by a controlled opening and closing of the line 10 that forms the pump bypass. Various combinations for the regulation of the injector pressure at the injector nozzle 3 are also conceivable.

It is also possible to provide a plurality of injector nozzles 3 each with its own shutoff valve 21 and an associated controllable bypass line 23, and so that, for example, each bottle 2 passes a plurality of injector nozzles for the foaming.

The following patents, patent applications or patent publications, are hereby incorporated by reference as if set forth in their entirety herein: DE 196 13 142 B4, having the following English translation of the German title "GAS SUPPLY SYSTEM FOR SOFT DRINKS DURING CLOSURE IN THE BOTTLING PLANT," published on Oct. 10, 1996; DE 41 35 438 A1, having the German title "VORRICHTUNG ZUM ERZEUGEN VON SCHAUM IM HALSE VON MIT KOHLENSÄUREHALTIGEN GETRÄNKEN GEFÜLLTEN FLASCHEN," published Feb. 22, 1967; DE 40 30 081 A1, having the following English translation of the German title "FROTHING APPARATUS AND METHOD FOR EVACUATING THE REMAINING AIR IN A CONTAINER FILLED WITH A FOAMING LIQUID, ESPECIALLY BOTTLES," published on Mar. 26, 1992; and DE 1 979 515 U, having the following English translation of the German title "METHOD OF GENERATING SOUND IN CARBONATED BEVERAGES—USES JET OF WATER OF VARIABLE IMPACT TO ALLOW NOZZLE TO BE VARIED IN POSITION," published on Apr. 29, 1993.

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

Some examples of pumps which may possibly be utilized or adapted for use in at least one possible embodiment according to the present application may possibly be found in the following U.S. Pat. No. 6,230,763, having the title "METHOD AND DEVICE FOR FILLING BARRELS," published on May 15, 2001; No. 5,727,933, having the title "PUMP AND FLOW SENSOR COMBINATION," published on Mar. 17, 1998; No. 4,834,624, having the title "PUMP ASSEMBLY FOR DELIVERING LIQUIDS AND GASES," published on May 30, 1989; No. 4,663,054, having the title "HOT PROCESS LIQUID TREATMENT METHOD AND APPARATUS," published on May 5, 1987; and that No. 4,426,732, having the title "RECEIVER HAVING A SURFACE ELASTIC WAVE HIGH FREQUENCY AMPLIFIER WITH A FREQUENCY-CONTROLLED PUMP OSCILLATOR," published on Jan. 17, 1984.

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

Some examples of frequency-controlled inverters which may possibly be utilized or adapted for use in at least one possible embodiment of the present application may possibly be found in the following U.S. Pat. No. 7,425,976, having the title "VARIABLE FREQUENCY GENERATOR," published on Sep. 16, 2008; U.S. Pat. No. 7,369,417, having the title "METHOD AND SYSTEM FOR PRODUCING CONTROLLED FREQUENCY POWER FROM A VARIABLE FREQUENCY POWER SOURCE," published on May 6, 2008; U.S. Pat. No. 7,170,262, having the title "VARIABLE FREQUENCY POWER SYSTEM AND METHOD OF USE," published on Jan. 30, 2007; No. 6,486,640, having the title "CONTROL SYSTEM FOR VARIABLE FREQUENCY GENERATOR," published on Nov. 26, 2002; and U.S. Pat. No. 5,909,367, having the title "MODULAR AC-AC VARIABLE FULL-PAGE AND VARIABLE FREQUENCY POWER CONVERTER SYSTEM AND CONTROL," published on Jun. 1, 1999.

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

This present application relates to a method for the controlled foaming of a liquid introduced into bottles or similar containers using at least one injector nozzle, through which a liquid foaming medium is injected under pressure into the containers as they are passing the nozzle, whereby the injection pressure is increased with an increasing number of containers passing the nozzle per unit of time, i.e. with an increasing number of containers per unit of time.

Some examples of frequency-controlled drive motors which may possibly be utilized or adapted in at least one possible embodiment of the present application may possibly be found in the following U.S. Pat. No. 6,957,805, having the title "GAS CHARGING UNIT OF A POLYURETHANE INJECTION MOLDING ASSEMBLY," published on Oct. 25, 2005; U.S. Pat. No. 6,328,475, having the title "AIR BEARING, IN PARTICULAR FOR THE SHAFT OF A MOTOR SPINDLE," published on Dec. 11, 2001; U.S. Pat. No. 5,605,295, having the title "METHOD AND DEVICE FOR WINDING YARN," published on Feb. 25, 1997; U.S. Pat. No. 5,163,895, having the title "CENTRIFUGE-DRIER," published on Nov. 17, 1992; U.S. Pat. No. 4,858,842, having the title "APPARATUS FOR WINDING WEBS TO FORM SUPPLY ROLLS," published on Aug. 22, 1989; and U.S. Pat. No. 4,752,044, having the title "YARN SUPPLY APPARATUS WITH ELECTRONIC YARN TENSION CONTROL, PARTICULARLY FOR KNITTING MACHINES HAVING RAPIDLY VARYING YARN SUPPLY REQUIREMENTS," published on Jun. 21, 1988.

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

One feature or aspect of an embodiment is believed at the time if the filing of this patent application to possibly reside broadly in a method for the controlled foaming of a liquid introduced into bottles 2 or similar containers using at least one injector nozzle 3, via which a liquid foaming medium is injected under pressure (injection pressure) into the containers 2 passing the nozzle 3, wherein the injector pressure is increased with an increasing number of containers 2 passing the nozzle 3 per unit of time, i.e. as the production rate increases, and that the injection of the foaming medium at a production rate significantly above 1,800 containers 2 per hour is greater than eight bar.

Another feature or aspect of an embodiment is believed at the time if the filing of this patent application to possibly reside broadly in the method, wherein the injection pressure for a production rate of approximately 2,800 containers 2 per hour lies in the range between one and three bar, for example 2.3 bar.

Yet another feature or aspect of an embodiment is believed at the time if the filing of this patent application to possibly reside broadly in the method, wherein the injection pressure for a production rate of approximately 25,000 to 30,000 containers 2 per hour is significantly greater than eight bar.

Still another feature or aspect of an embodiment is believed at the time if the filing of this patent application to possibly reside broadly in the method, wherein the injector pressure for a production rate of approximately 25,000 to 30,000 containers 2 per hour is approximately fifteen bar.

A further feature or aspect of an embodiment is believed at the time if the filing of this patent application to possibly reside broadly in the method, wherein the quantity of treatment medium injected into each of the containers 2 is less than 0.05 milliliter.

Another feature or aspect of an embodiment is believed at the time if the filing of this patent application to possibly reside broadly in the method, wherein the quantity of treatment medium injected into each of the containers 2 increases as the production rate decreases.

Yet another feature or aspect of an embodiment is believed at the time if the filing of this patent application to possibly reside broadly in the method, wherein the quantity of foaming medium injected is varied as a function of the production rate by a maximum ratio of 1:4 or 1:3.

Still another feature or aspect of an embodiment is believed at the time if the filing of this patent application to possibly reside broadly in the method, wherein the foaming medium is introduced into the containers hot, e.g. at a temperature in the range between eighty degrees Celsius and ninety degrees Celsius.

A further feature or aspect of an embodiment is believed at the time if the filing of this patent application to possibly reside broadly in the method, wherein water is used as the foaming medium.

Another feature or aspect of an embodiment is believed at the time if the filing of this patent application to possibly reside broadly in the method, wherein the liquid being introduced into the bottles is used as the foaming medium.

Yet another feature or aspect of an embodiment is believed at the time if the filing of this patent application to possibly reside broadly in the method, wherein after the introduction of the foaming medium, the foaming of the liquid being bottled is monitored, often by means of an optoelectrical sensor and/or the sensor signal supplied by the sensor is used to control the introduction of the foaming medium into the container 2 and/or other parameters that affect the foaming.

Still another feature or aspect of an embodiment is believed at the time if the filing of this patent application to possibly reside broadly in the method, wherein the injection pressure and/or the speed at which the containers pass the at least one injector nozzle 3 are controlled with the sensor signal.

A further feature or aspect of an embodiment is believed at the time if the filing of this patent application to possibly reside broadly in the method, including the use of a pump 5 with a frequency-controlled drive mechanism for the regulation of the injection pressure.

Another feature or aspect of an embodiment is believed at the time if the filing of this patent application to possibly reside broadly in the method, including the use of a pump with a pump pressure that can be varied by a variation of the speed of rotation by a factor of at least six, e.g. by a factor of seven.

Yet another feature or aspect of an embodiment is believed at the time if the filing of this patent application to possibly reside broadly in a device for the controlled foaming of a liquid introduced into bottles 2 or similar containers using at least one injector nozzle 3, via which a liquid foaming medium is injected under pressure (injection pressure) into the containers 2 passing the nozzle 3, comprising a control unit 29 which increases the injection pressure as the number of containers 2 passing the nozzle 3 per unit of time increases, i.e. as the production rate increases, and is realized so that the injection pressure of the foaming medium at a production rate significantly above 1,800 containers 2 per hour is greater than eight bar.

Still another feature or aspect of an embodiment is believed at the time if the filing of this patent application to possibly reside broadly in the device, wherein the injection pressure controlled by the control device 29 at a production rate of approximately 2,800 containers 2 per hour lies in the range between one and three bar, for example 2.3 bar.

A further feature or aspect of an embodiment is believed at the time if the filing of this patent application to possibly reside broadly in the device, wherein the injection pressure controlled by the control device 29 for a production rate of approximately 25,000 to 30,000 containers 2 per hour is significantly greater than eight bar.

Another feature or aspect of an embodiment is believed at the time if the filing of this patent application to possibly reside broadly in the device, wherein the injection pressure controlled by the control device 29 for a production rate of approximately 25,000 to 30,000 containers 2 per hour is approximately fifteen bar.

Yet another feature or aspect of an embodiment is believed at the time if the filing of this patent application to possibly reside broadly in the device, wherein under the control of the control device 29, the quantity of treatment medium injected into each container 2 is less than 0.05 milliliter.

Still another feature or aspect of an embodiment is believed at the time if the filing of this patent application to possibly reside broadly in the device, wherein under the control of the control device 29, the quantity of treatment medium injected into each container 2 is increased as the production rate decreases.

A further feature or aspect of an embodiment is believed at the time if the filing of this patent application to possibly reside broadly in the device, wherein under the control of the control device 29, the quantity of foaming medium injected is varied as a function of the production rate by a maximum ratio of 1:4 or 1:3.

Another feature or aspect of an embodiment is believed at the time if the filing of this patent application to possibly reside broadly in the device, wherein water is used as the foaming medium.

Yet another feature or aspect of an embodiment is believed at the time if the filing of this patent application to possibly reside broadly in the device, wherein the liquid being introduced into the bottles 2 is used as the foaming medium.

Still another feature or aspect of an embodiment is believed at the time if the filing of this patent application to possibly reside broadly in the device, comprising a sensor, often an optoelectrical sensor 31 for the monitoring of the foaming of the liquid being bottled.

A further feature or aspect of an embodiment is believed at the time if the filing of this patent application to possibly reside broadly in the device, comprising a pump 5 with a frequency-controlled drive for the regulation of the injection pressure.

Another feature or aspect of an embodiment is believed at the time if the filing of this patent application to possibly reside broadly in the device, comprising a pump with a pump pressure which can be varied by a factor of at least six, often by a factor of seven, by varying the speed of rotation.

Yet another feature or aspect of an embodiment is believed at the time if the filing of this patent application to possibly reside broadly in the device, wherein a pump bypass is provided parallel or virtually parallel to the pump 5.

Still another feature or aspect of an embodiment is believed at the time if the filing of this patent application to possibly reside broadly in the device, wherein the delivery capacity of the pump is greater than the quantity of foaming medium discharged at the injector nozzle.

A further feature or aspect of an embodiment is believed at the time if the filing of this patent application to possibly reside broadly in the device, comprising a device 15 for the heating of the foaming medium.

Another feature or aspect of an embodiment is believed at the time if the filing of this patent application to possibly reside broadly in the device, wherein the device for the heating of the foaming medium is provided between the pump 5 and the at least one injector nozzle 3.

Yet another feature or aspect of an embodiment is believed at the time if the filing of this patent application to possibly reside broadly in the device, wherein in a line 20 that leads to the at least one injector nozzle 3 there is at least one valve 21 that shuts off the injector nozzle 3 and that a controllable bypass line 23 branches off upstream of this valve 21 in the direction of flow.

Still another feature or aspect of an embodiment is believed at the time if the filing of this patent application to possibly reside broadly in the device, wherein a controllable bypass line 26 branches off in a connecting line between the pump 5 and the device 15 for the heating of the foaming medium.

A further feature or aspect of an embodiment is believed at the time if the filing of this patent application to possibly reside broadly in the device, wherein the at least one injector nozzle 30 is provided on a conveyor line which is formed by at least one conveyor element, such as a transport star wheel, for example, between a filling machine and a closing or capping machine.

Another feature or aspect of an embodiment is believed at the time if the filing of this patent application to possibly reside broadly in the device, wherein the at least one injector nozzle 3 is provided in the outlet star wheel of the filling machine.

One feature or aspect of an embodiment is believed at the time if the filing of this patent application to possibly reside broadly in a method for the controlled foaming of a liquid introduced into bottles 2 or similar containers, using at least one injector nozzle 3, via which a liquid foaming medium is injected under pressure in the containers 2 passing the nozzle 3, whereby the foaming medium is injected at a pressure of two to sixteen bar and the injection pressure is increased with an increasing number of containers 2 passing the nozzle 3 per unit of time, i.e. as the production rate is increased, whereby parallel or virtually parallel to the pump 5 a bypass line 10 is provided, whereby the pump 5 is used with a frequency-controlled drive for the regulation of the injection pressure and the bypass line 1 essentially guarantees or promotes the minimum flow through the pump 5.

Another feature or aspect of an embodiment is believed at the time if the filing of this patent application to possibly reside broadly in the method, wherein the pump 5 is connected in series with a flow meter 6 and a bypass line 10 is provided parallel or virtually parallel to it.

Yet another feature or aspect of an embodiment is believed at the time if the filing of this patent application to possibly reside broadly in the method, wherein located in the bypass line 1 there are a choke 11, a pressure sensor 12 and a temperature sensor 13.

Still another feature or aspect of an embodiment is believed at the time if the filing of this patent application to possibly reside broadly in the method, wherein during normal operation, the flow cross section formed by the choke 11 is such that a minimum flow through the pump 5 that is sufficient for the lubrication and cooling of the pump 5 is essentially guaranteed are promoted.

A further feature or aspect of an embodiment is believed at the time if the filing of this patent application to possibly reside broadly in the method, wherein the injection pressure for a production rate of approximately 25,000 to 30,000 containers 2 per hour is significantly greater than eight bar and possibly up to sixteen bar.

Device for the controlled foaming of a liquid introduced into bottles 2 or similar containers with at least one injector nozzle 3, via which a liquid foaming medium is injected under pressure into the containers 2 passing this nozzle 3, whereby a control device 29 which increases the injection pressure with an increase in the number of the containers 2 that pass the nozzle 3 per unit of time, i.e. as the production rate increases, whereby the control device 29 keeps the quantity of treatment medium injected into the individual containers 2 less than 0.05 milliliter and the pump 5 is equipped with a frequency-controlled drive for the regulation of the injection pressure.

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the International Search Report dated Aug. 9, 2007, and/or cited elsewhere are hereby incorporated by reference as if set forth in their entirety herein as follows: EP 0 479 030, having the following English translation of the German title "FROTHING APPARATUS AND METHOD FOR EVACUATING THE REMAINING AIR IN A CONTAINER FILLED WITH A FOAMING LIQUID, ESPECIALLY BOTTLES," published on Apr. 8, 1992; DE 16 32 034, having the German title "VERFAHREN UND VORRICHTUNG ZUM ERZEUGEN VON SCHAUM IM HALSE VON MIT KOHLENSAEUREHALTIGEN GETRAENKEN GEFUELLTEN FLASCHEN," published on Mar. 2, 1972; DE 41 35 438, having the following English translation of the German title "METHOD OF GENERATING FOAM IN CARBONATED BEVERAGES—USES JET OF WATER OF VARIABLE IMPACT TO ALLOW NOZZLE TO BE VARIED IN POSITION," published on Apr. 28, 1993; U.S. Pat. No. 4,514,953, having the title "DEVICE FOR REMOVING AIR FROM FILLED BOTTLES OR OTHER CONTAINERS," published on May 7, 1985; GB 1,395,607, having the title "IMPROVEMENTS RELATING TO PROCESSES AND APPARATUS FOR THE REMOVAL OF AIR FROM BOTTLED BEVERAGES," published on May 29, 1975; and CA 1,195,303, having the title "BOTTLE DEAERATING DEVICE," published on Oct. 15, 1985.

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 022 464.7, filed on May 13, 2006, having inventors Gernod HAAS and Olaf MUSZINSKI, and DE-OS 10 2006 022 464.7 and DE-PS10 2006 022 464.7, and International Application No. PCT/EP2007/004216, filed on May 11, 2007, having WIPO Publication No. WO 2007/131733 and inventors Gernod HAAS and Olaf MUSZINSKI, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/004216 and German Patent Application 10 2006 022 464.7 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/004216 and Oct. 31, 2008 DE 10 2006 022 464.7 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

AT LEAST PARTIAL NOMENCLATURE

| | |
|---|---|
| 1 | High pressure injection device |
| 2 | Bottle |
| 3 | Injector nozzle |
| 4 | Pump circuit |
| 5 | Pump |
| 6 | Flow meter |
| 7 | Line |
| 8 | Source for the liquid foaming medium |
| 9 | Temperature sensor |
| 10 | Line of the pump bypass |
| 11 | Choke |
| 12 | Pressure sensor |
| 13 | Temperature sensor |
| 14 | Line |

-continued

| | |
|---|---|
| 15 | Boiler |
| 16 | Heating circuit |
| 17 | Pressure sensor |
| 18 | Level sensor |
| 19 | Temperature sensor |
| 20 | Line |
| 21 | Shutoff valve |
| 22 | Temperature sensor |
| 23 | Bypass line |
| 24 | Shutoff valve |
| 25 | Drain |
| 26 | Bypass line |
| 27 | Shutoff valve |
| 28 | Drain |
| 29 | Control device |
| 30 | Memory |
| 31 | Sensor |

What is claimed is:

1. A method of operating a foaming device in a beverage bottling plant to reduce interruptions in the bottling process due to malfunctions relating to said foaming device, said foaming device being configured to inject heated, pressurized water into a bottle filled with an effervescent beverage material in order to agitate the effervescent beverage material and cause the effervescent beverage material to foam and therefore displace air present in a bottle above the level of the effervescent beverage bottle and comprising: a first line arrangement being configured and disposed to receive unheated water from a source of unheated water; a plurality of injector nozzles being configured and disposed to inject heated water with a pressure in the range of about two bar to about sixteen bar into a bottle filled with an effervescent beverage material in order to agitate the effervescent beverage material and cause the effervescent beverage material to foam and therefore displace air present in a bottle above the level of the effervescent beverage in a bottle; a pump being disposed to receive unheated water from said first line arrangement and being configured to produce sufficiently heated water at a sufficient pressure to said plurality of injection nozzles; said pump comprising: an inlet; an outlet; and a frequency-controlled drive motor being configured and disposed to run said pump; said frequency-controlled drive motor being further configured to vary the speed of said frequency-controlled drive motor and output of said frequency-controlled drive motor depending on the input frequency; a bypass line arrangement being configured and disposed to operatively permit the flow of unheated water from said outlet of said pump back to said inlet of said pump; said bypass line arrangement being configured to provide sufficient water for lubrication and cooling of said pump to minimize malfunctioning of said pump during periods of low demand for heated, pressurized water by said plurality of injector nozzles; a water heater being disposed to receive unheated water from said pump and being configured to heat unheated water to produce heated water; a temperature sensor being configured and disposed to sense the temperature of water being heated for delivery to said plurality of injector nozzles; a pressure sensor being configured and disposed to sense the pressure of water being heated for delivery to said plurality of injector nozzles; a second line arrangement being configured and disposed to receive heated water from said water heater and deliver water to said plurality of injector nozzles at a desired temperature and pressure; at least one valve being disposed in said second line arrangement and being configured to restrict the flow of heated water in said second line arrangement; a foaming sensor being configured and disposed to sense foaming in bottles upon heated water being injected; a control device being configured and disposed to receive signals from said sensors and to control said pump and said water heater to provide heated water at a desired temperature and pressure to said plurality of injector nozzles as production of bottles filled with an effervescent beverage material changes; said control device being further configured to provide variable frequency operating voltages to run the frequency-controlled drive motor; said pump being further configured to increase the water pressure at said plurality of injector nozzles as production rates increase and to decrease the water pressure at said plurality of injector nozzles as production rates decrease; and said frequency-controlled drive motor being further configured to run at a higher speed to increase the output of said pump as production rates increase and to run at a slower speed to decrease the output of said pump as production rates decrease; and said frequency-controlled drive motor comprising a frequency-controlled inverter being configured and disposed to change voltage into frequency;

said method comprising the steps of:

providing a variable frequency operating voltage to run said frequency-controlled drive motor and therefore running said pump;

pumping unheated water from said first line arrangement to said water heater and providing water at a predetermined pressure;

heating water in said water heater;

sensing the temperature and pressure of water being heated for delivery to said plurality of injector nozzles with said temperature sensor and said pressure sensor;

delivering heated water to said plurality of injector nozzles at a desired temperature and pressure with said second line arrangement;

injecting heated water with a pressure in the range of about two bar to about sixteen bar into bottles filled with effervescent beverage material, thereby agitating the effervescent beverage material and foaming the effervescent beverage material and displacing air present in said bottles above the level of the effervescent beverage in said bottles;

sensing foaming in said bottle upon heated water being injected with said foaming sensor; and increasing the supply frequency to run said frequency-controlled drive motor and therefore running said pump at a higher speed and thus increasing the water pressure at said plurality of injector nozzles as production rates increase;

decreasing the supply frequency to said frequency-controlled drive motor and therefore running said pump at a slower speed and thus decreasing the water pressure at said plurality of injector nozzles as production rates decrease; and permitting a flow of unheated water from said outlet of said pump back to said inlet of said pump to provide sufficient water for lubrication and cooling of said pump to minimize malfunctioning of said pump during periods of low demand for heated, pressurized water by said plurality of injector nozzles.

2. The method of operating said foaming device according to claim 1, wherein:

the injection pressure for a production rate of approximately 2,800 bottles per hour is at least one of (A) and (B):

(A) in the range between one and three bar; and (B) 2.3 bar;

the injector pressure for a production rate of approximately 25,000 to 30,000 bottles per hour is approximately fifteen bar; and the quantity of heated water injected into each of the bottles is less than 0.05 milliliter.

3. The method of operating said foaming device according to claim 2, wherein:

the quantity of heated water injected into each of the bottles increases as the production rate decreases;

the quantity of heated water injected is varied as a function of the production rate by a maximum ratio of 1:4 or 1:3; and the heated water is introduced into the bottles hot, e.g. at a temperature in the range between about eighty degrees Celsius and about ninety degrees Celsius.

4. The method of operating said foaming device according to claim 3, wherein:

the heated water being introduced into the bottles is used as the foaming medium; and after the introduction of the foaming medium, the foaming of the liquid being bottled is monitored by means of an optoelectrical sensor and/or the sensor signal supplied by the sensor is used to control the introduction of the foaming medium into the bottle and/or other parameters that affect the foaming.

5. The method of operating said foaming device according to claim 4, wherein:

the injection pressure and/or the speed at which the bottles pass the at least one injector nozzle are controlled with the sensor signal;

said frequency-controlled drive motor is used for the regulation of the injection pressure; and the injection pressure can be varied by a variation of the speed of rotation by one of (C) and (D):

(C) a factor of at least six; and (D) by a factor of seven.

6. The method of operating said foaming device according to claim 5, wherein:

said pump is connected in series with a flow meter and said bypass line arrangement is provided parallel to it; and located in the bypass line arrangement there are a choke, a pressure sensor, and a temperature sensor.

7. The method of operating said foaming device according to claim 6, wherein:

during normal operation, the flow cross section formed by said choke is such that a minimum flow through said pump that is sufficient for the lubrication and cooling of the said pump is essentially guaranteed; and the injection pressure for a production rate of approximately 25,000 to 30,000 bottles per hour is one of (E) and (F):

(E) significantly greater than eight bar; and (F) up to sixteen bar.

8. A foaming device being configured to inject heated, pressurized water into a bottle filled with an effervescent beverage material in order to agitate the effervescent beverage material and cause the effervescent beverage material to foam and therefore displace air present in a bottle above the level of the effervescent beverage in a bottle, said foaming device comprising:

a first line arrangement being configured and disposed to receive unheated water from a source of unheated water;

a plurality of injector nozzles being configured and disposed to inject heated water with a pressure in the range of about two bar to about sixteen bar into a bottle filled with an effervescent beverage material in order to agitate the effervescent beverage material and cause the effervescent beverage material to foam and therefore displace air present in a bottle above the level of the effervescent beverage in a bottle;

a pump being disposed to receive unheated water from said first line arrangement and being configured to produce sufficiently heated water at a sufficient pressure to said plurality of injection nozzles;

said pump comprising:

an inlet;

an outlet; and a frequency-controlled drive motor being configured and disposed to run said pump;

said frequency-controlled drive motor being further configured to vary the speed of said frequency-controlled drive motor and output of said frequency-controlled drive motor depending on the input frequency;

a bypass line arrangement being configured and disposed to operatively permit the flow of unheated water from said outlet of said pump back to said inlet of said pump;

said bypass line arrangement being configured to provide sufficient water for lubrication and cooling of said pump to minimize malfunctioning of said pump during periods of low demand for heated, pressurized water by said plurality of injector nozzles;

a water heater being disposed to receive unheated water from said pump and being configured to heat unheated water to produce heated water;

a temperature sensor being configured and disposed to sense the temperature of water being heated for delivery to said plurality of injector nozzles;

a pressure sensor being configured and disposed to sense the pressure of water being heated for delivery to said plurality of injector nozzles;

a second line arrangement being configured and disposed to receive heated water from said water heater and deliver water to said plurality of injector nozzles at a desired temperature and pressure;

at least one valve being disposed in said second line arrangement and being configured to restrict the flow of heated water in said second line arrangement;

a foaming sensor being configured and disposed to sense foaming in bottles upon heated water being injected;

a control device being configured and disposed to receive signals from said sensors and to control said pump and said water heater to provide heated water at a desired temperature and pressure to said plurality of injector nozzles as production of bottles filled with an effervescent beverage material changes;

said control device being further configured to provide variable frequency operating voltages to run the frequency-controlled drive motor;

said pump being further configured to increase the water pressure at said plurality of injector nozzles as production rates increase and to decrease the water pressure at said plurality of injector nozzles as production rates decrease; and said frequency-controlled drive motor being further configured to run at a higher speed to increase the output of said pump as production rates increase and to run at a slower speed to decrease the output of said pump as production rates decrease; and said frequency-controlled drive motor comprising a frequency-controlled inverter being configured and disposed to change voltage into frequency.

9. The foaming device according to claim 8, wherein the injection pressure controlled by said control device:

at a production rate of approximately 2,800 bottles per hour lies in at least one of (A) and (B):

(A) the range between about one and about three bar; and (B) 2.3 bar;

for a production rate of approximately 25,000 to 30,000 bottles per hour is significantly greater than eight bar;

for a production rate of approximately 25,000 to 30,000 bottles per hour is about fifteen bar.

10. The foaming device according to claim 9, wherein:

under the control of said control device, the quantity of heated water injected into each bottle is less than 0.05 milliliter;

under the control of said control device, the quantity of heated water injected into each bottle is increased as the production rate decreases; and under the control of said control device, the quantity of heated water injected is varied as a function of the production rate by a maximum ratio of 1:4 or 1:3.

11. The foaming device according to claim 10, wherein:

the heated water being introduced into the bottles is used as a foaming medium; and said foaming sensor further comprises an optoelectrical sensor for the monitoring of the foaming of the liquid being bottled.

12. The foaming device according to claim 11, wherein:

said pump and said frequency-controlled drive motor regulates the injection pressure;

the injection pressure can be varied by a variation of the speed of rotation by one of (C) and (D):

(C) a factor of at least six; and (D) by a factor of seven; and said bypass arrangement is provided substantially parallel to said pump.

13. The foaming device according to claim 12, wherein:

the delivery capacity of said pump is greater than the quantity of foaming medium discharged at said plurality of injector nozzles; and said water heater for the heating of the foaming medium is provided between said pump and said plurality of injector nozzles.

14. The foaming device according to claim 13, wherein:

said foaming device further comprises:

at least one valve disposed on said second line arrangement that shuts off each of said plurality of injector nozzles;

a first controllable bypass line which branches off upstream of said at least one valve in the direction of flow;

a second controllable bypass line which branches off in a connecting line between said pump and said water heater;

each of said plurality of injector nozzles is provided on a conveyor line which is formed by at least one conveyor element, such as a transport star wheel, for example, between a filling machine and a closing or capping machine; and each of said plurality of injector nozzles is provided in the outlet star wheel of the filling machine.

15. Method for the controlled foaming of a liquid introduced into bottles (2) or similar containers, using at least one injector nozzle (3), via which a liquid foaming medium is injected under pressure in the containers (2) passing the nozzle (3), whereby the foaming medium is injected at a pressure of 2 to 16 bar and the injection pressure is increased with an increasing number of containers (2) passing the nozzle (3) per unit of time, i.e. as a production rate is increased, whereby parallel to a pump (5) a bypass line (10) is provided, whereby the pump (5) is used with a frequency-controlled drive for the regulation of the injection pressure and the bypass line (1) guarantees a minimum flow through the pump (5).

16. Method as recited in claim 15, said method further comprising one of (I), (II), (III), (IV), (V), (VI), (VII), and (VIII), wherein:

(I) the injection pressure for a production rate of approximately 2,800 containers (2) per hour lies in the range between 1 and 3 bar, for example 2.3 bar;

(II) the injection pressure for a production rate of approximately 2,800 containers (2) per hour lies in the range between 1 and 3 bar, for example 2.3 bar; and the injection pressure for a production rate of approximately 25,000 to 30,000 containers (2) per hour is significantly greater than 8 bar and ideally up to 16 bar;

(III) the injection pressure for a production rate of approximately 2,800 containers (2) per hour lies in the range between 1 and 3 bar, for example 2.3 bar;

the injection pressure for a production rate of approximately 25,000 to 30,000 containers (2) per hour is significantly greater than 8 bar and ideally up to 16 bar; and the injector pressure for a production rate of approximately 25,000 to 30,000 containers (2) per hour is approximately 15 bar;

(IV) the injection pressure for a production rate of approximately 2,800 containers (2) per hour lies in the range between 1 and 3 bar, for example 2.3 bar;

the injection pressure for a production rate of approximately 25,000 to 30,000 containers (2) per hour is significantly greater than 8 bar and ideally up to 16 bar;

the injector pressure for a production rate of approximately 25,000 to 30,000 containers (2) per hour is approximately 15 bar; and the quantity of treatment medium injected into each of the containers (2) is less than 0.05 milliliter;

(V) the injection pressure for a production rate of approximately 2,800 containers (2) per hour lies in the range between 1 and 3 bar, for example 2.3 bar;

the injection pressure for a production rate of approximately 25,000 to 30,000 containers (2) per hour is significantly greater than 8 bar and ideally up to 16 bar;

the injector pressure for a production rate of approximately 25,000 to 30,000 containers (2) per hour is approximately 15 bar;

the quantity of treatment medium injected into each of the containers (2) is less than 0.05 milliliter; and the quantity of treatment medium injected into each of the containers (2) increases as the production rate decreases;

(VI) the injection pressure for a production rate of approximately 2,800 containers (2) per hour lies in the range between 1 and 3 bar, for example 2.3 bar;

the injection pressure for a production rate of approximately 25,000 to 30,000 containers (2) per hour is significantly greater than 8 bar and ideally up to 16 bar;

the injector pressure for a production rate of approximately 25,000 to 30,000 containers (2) per hour is approximately 15 bar;

the quantity of treatment medium injected into each of the containers (2) is less than 0.05 milliliter;

the quantity of treatment medium injected into each of the containers (2) increases as the production rate decreases; and the quantity of foaming medium injected is varied as a function of the production rate by a maximum ratio of 1:4 or 1:3;

(VII) the injection pressure for a production rate of approximately 2,800 containers (2) per hour lies in the range between 1 and 3 bar, for example 2.3 bar;

the injection pressure for a production rate of approximately 25,000 to 30,000 containers (2) per hour is significantly greater than 8 bar and ideally up to 16 bar;

the injector pressure for a production rate of approximately 25,000 to 30,000 containers (2) per hour is approximately 15 bar;

the quantity of treatment medium injected into each of the containers (2) is less than 0.05 milliliter;

the quantity of treatment medium injected into each of the containers (2) increases as the production rate decreases;

the quantity of foaming medium injected is varied as a function of the production rate by a maximum ratio of 1:4 or 1:3; and the foaming medium is introduced into the containers hot, e.g. at a temperature in the range between 80° C. and 90° C.; and (VIII) the injection pressure for a production rate of approximately 2,800 containers (2) per hour lies in the range between 1 and 3 bar, for example 2.3 bar;

the injection pressure for a production rate of approximately 25,000 to 30,000 containers (2) per hour is significantly greater than 8 bar and ideally up to 16 bar;

the injector pressure for a production rate of approximately 25,000 to 30,000 containers (2) per hour is approximately 15 bar;

the quantity of treatment medium injected into each of the containers (2) is less than 0.05 milliliter;

the quantity of treatment medium injected into each of the containers (2) increases as the production rate decreases;

the quantity of foaming medium injected is varied as a function of the production rate by a maximum ratio of 1:4 or 1:3; and the foaming medium is introduced into the containers hot, e.g. at a temperature in the range between 80° C. and 90° C.; and water is used as the foaming medium.

17. Method as recited in claim 16, said method further comprising one of (IX), (X), (XI), (XII), (XIII), (XIV), (XV), and (XVI), wherein:

(IX) the liquid being introduced into the bottles is used as the foaming medium;

(X) the liquid being introduced into the bottles is used as the foaming medium; and after the introduction of the foaming medium, the foaming of the liquid being bottled is monitored, preferably by means of an optoelectrical sensor and/or the sensor signal supplied by the sensor is used to control the introduction of the foaming medium into the container (2) and/or other parameters that affect the foaming;

(XI) the liquid being introduced into the bottles is used as the foaming medium;

after the introduction of the foaming medium, the foaming of the liquid being bottled is monitored, preferably by means of an optoelectrical sensor and/or the sensor signal supplied by the sensor is used to control the introduction of the foaming medium into the container (2) and/or other parameters that affect the foaming; and the injection pressure and/or the speed at which the containers pass the at least one injector nozzle (3) are controlled with the sensor signal;

(XII) the liquid being introduced into the bottles is used as the foaming medium;

after the introduction of the foaming medium, the foaming of the liquid being bottled is monitored, preferably by means of an optoelectrical sensor and/or the sensor signal supplied by the sensor is used to control the introduction of the foaming medium into the container (2) and/or other parameters that affect the foaming;

the injection pressure and/or the speed at which the containers pass the at least one injector nozzle (3) are controlled with the sensor signal; and including the use of a pump (5) with a frequency-controlled drive mechanism for the regulation of the injection pressure;

(XIII) the liquid being introduced into the bottles is used as the foaming medium;

after the introduction of the foaming medium, the foaming of the liquid being bottled is monitored, preferably by means of an optoelectrical sensor and/or the sensor signal supplied by the sensor is used to control the introduction of the foaming medium into the container (2) and/or other parameters that affect the foaming;

the injection pressure and/or the speed at which the containers pass the at least one injector nozzle (3) are controlled with the sensor signal;

including the use of a pump (5) with a frequency-controlled drive mechanism for the regulation of the injection pressure; and including the use of a pump with a pump pressure that can be varied by a variation of the speed of rotation by a factor of at least six, e.g. by a factor of seven;

(XIV) the liquid being introduced into the bottles is used as the foaming medium;

after the introduction of the foaming medium, the foaming of the liquid being bottled is monitored, preferably by means of an optoelectrical sensor and/or the sensor signal supplied by the sensor is used to control the introduction of the foaming medium into the container (2) and/or other parameters that affect the foaming;

the injection pressure and/or the speed at which the containers pass the at least one injector nozzle (3) are controlled with the sensor signal;

including the use of a pump (5) with a frequency-controlled drive mechanism for the regulation of the injection pressure;

including the use of a pump with a pump pressure that can be varied by a variation of the speed of rotation by a factor of at least six, e.g. by a factor of seven; and the pump (5) is connected in series with a flow meter (6) and a bypass line (10) is provided parallel to it;

(XV) the liquid being introduced into the bottles is used as the foaming medium;

after the introduction of the foaming medium, the foaming of the liquid being bottled is monitored, preferably by means of an optoelectrical sensor and/or the sensor signal supplied by the sensor is used to control the introduction of the foaming medium into the container (2) and/or other parameters that affect the foaming;

the injection pressure and/or the speed at which the containers pass the at least one injector nozzle (3) are controlled with the sensor signal;

including the use of a pump (5) with a frequency-controlled drive mechanism for the regulation of the injection pressure;

including the use of a pump with a pump pressure that can be varied by a variation of the speed of rotation by a factor of at least six, e.g. by a factor of seven;

the pump (5) is connected in series with a flow meter (6) and a bypass line (10) is provided parallel to it; and located in the bypass line (1) there are a choke (11), a pressure sensor (12) and a temperature sensor (13); and (XVI) the liquid being introduced into the bottles is used as the foaming medium;

after the introduction of the foaming medium, the foaming of the liquid being bottled is monitored, preferably by means of an optoelectrical sensor and/or the sensor signal supplied by the sensor is used to control the introduction of the foaming medium into the container (2) and/or other parameters that affect the foaming;

the injection pressure and/or the speed at which the containers pass the at least one injector nozzle (3) are controlled with the sensor signal;

including the use of a pump (5) with a frequency-controlled drive mechanism for the regulation of the injection pressure;

including the use of a pump with a pump pressure that can be varied by a variation of the speed of rotation by a factor of at least six, e.g. by a factor of seven;

the pump (5) is connected in series with a flow meter (6) and a bypass line (10) is provided parallel to it;

located in the bypass line (1) there are a choke (11), a pressure sensor (12) and a temperature sensor (13); and during normal operation, the flow cross section formed by the choke (11) is such that a minimum flow through the pump (5) that is sufficient for the lubrication and cooling of the pump (5) is guaranteed.

18. Method as recited in claim 17 including a device, said device comprising one of (AA), (BB), (CC), (DD), (EE), (FF), (GG), and (HH):

(AA) characterized by a pump with a pump pressure that can be varied by a variation of the speed of rotation by a factor of at least six, e.g. by a factor of seven;

(BB) characterized by a pump with a pump pressure that can be varied by a variation of the speed of rotation by a factor of at least six, e.g. by a factor of seven; and a pump-bypass is provided parallel to the pump (5);

(CC) characterized by a pump with a pump pressure that can be varied by a variation of the speed of rotation by a factor of at least six, e.g. by a factor of seven;

a pump-bypass is provided parallel to the pump (5); and characterized in that the injection pressure controlled by the control device (29) at a production rate of approximately 2,800 containers (2) per hour lies in the range between 1 and 3 bar, for example 2.3 bar;

(DD) characterized by a pump with a pump pressure that can be varied by a variation of the speed of rotation by a factor of at least six, e.g. by a factor of seven;

a pump-bypass is provided parallel to the pump (5);

characterized in that the injection pressure controlled by the control device (29) at a production rate of approximately 2,800 containers (2) per hour lies in the range between 1 and 3 bar, for example 2.3 bar; and characterized in that the injection pressure controlled by the control device (29) for a production rate of approximately 25,000 to 30,000 containers (2) per hour is greater than 8 bar;

(EE) characterized by a pump with a pump pressure that can be varied by a variation of the speed of rotation by a factor of at least six, e.g. by a factor of seven;

a pump-bypass is provided parallel to the pump (5);

characterized in that the injection pressure controlled by the control device (29) at a production rate of approximately 2,800 containers (2) per hour lies in the range between 1 and 3 bar, for example 2.3 bar;

characterized in that the injection pressure controlled by the control device (29) for a production rate of approximately 25,000 to 30,000 containers (2) per hour is greater than 8 bar; and characterized in that the injection pressure controlled by the control device (29) for a production rate of approximately 25,000 to 30,000 containers (2) per hour is approximately 15 bar;

(FF) characterized by a pump with a pump pressure that can be varied by a variation of the speed of rotation by a factor of at least six, e.g. by a factor of seven;

a pump-bypass is provided parallel to the pump (5);

characterized in that the injection pressure controlled by the control device (29) at a production rate of approximately 2,800 containers (2) per hour lies in the range between 1 and 3 bar, for example 2.3 bar;

characterized in that the injection pressure controlled by the control device (29) for a production rate of approximately 25,000 to 30,000 containers (2) per hour is greater than 8 bar;

characterized in that the injection pressure controlled by the control device (29) for a production rate of approximately 25,000 to 30,000 containers (2) per hour is approximately 15 bar; and characterized in that under the control of the control device (29), the quantity of treatment medium injected into each container (2) is increased as the production rate decreases;

(GG) characterized by a pump with a pump pressure that can be varied by a variation of the speed of rotation by a factor of at least six, e.g. by a factor of seven;

a pump-bypass is provided parallel to the pump (5);

characterized in that the injection pressure controlled by the control device (29) at a production rate of approximately 2,800 containers (2) per hour lies in the range between 1 and 3 bar, for example 2.3 bar;

characterized in that the injection pressure controlled by the control device (29) for a production rate of approximately 25,000 to 30,000 containers (2) per hour is greater than 8 bar;

characterized in that the injection pressure controlled by the control device (29) for a production rate of approximately 25,000 to 30,000 containers (2) per hour is approximately 15 bar;

characterized in that under the control of the control device (29), the quantity of treatment medium injected into each container (2) is increased as the production rate decreases; and characterized in that under the control of the control device (29), the quantity of foaming medium injected is varied as a function of the production rate by a maximum ratio of 1:4 or 1:3;

(HH) characterized by a pump with a pump pressure that can be varied by a variation of the speed of rotation by a factor of at least six, e.g. by a factor of seven;

a pump-bypass is provided parallel to the pump (5);

characterized in that the injection pressure controlled by the control device (29) at a production rate of approximately 2,800 containers (2) per hour lies in the range between 1 and 3 bar, for example 2.3 bar;

characterized in that the injection pressure controlled by the control device (29) for a production rate of approximately 25,000 to 30,000 containers (2) per hour is greater than 8 bar;

characterized in that the injection pressure controlled by the control device (29) for a production rate of approximately 25,000 to 30,000 containers (2) per hour is approximately 15 bar;

characterized in that under the control of the control device (29), the quantity of treatment medium injected into each container (2) is increased as the production rate decreases;

characterized in that under the control of the control device (29), the quantity of foaming medium injected is varied as a function of the production rate by a maximum ratio of 1:4 or 1:3; and characterized by a sensor, preferably an optoelectrical sensor (31) for the monitoring of the foaming of the liquid being bottled.

19. Method as recited in claim 18 including said device, said device further comprising one of (JJ), (KK), (LL), and (MM):

(JJ) characterized in that the delivery capacity of the pump is greater than the quantity of foaming medium discharged at the injector nozzle;

(KK) characterized in that the delivery capacity of the pump is greater than the quantity of foaming medium discharged at the injector nozzle; and characterized by a device (15) for the heating of the foaming medium;

(LL) characterized in that the delivery capacity of the pump is greater than the quantity of foaming medium discharged at the injector nozzle;

characterized by a device (15) for the heating of the foaming medium; and characterized in that the device for the heating of the foaming medium is provided between the pump (5) and the at least one injector nozzle (3); and (MM) characterized in that the delivery capacity of the pump is greater than the quantity of foaming medium discharged at the injector nozzle;

characterized by a device (15) for the heating of the foaming medium;

characterized in that the device for the heating of the foaming medium is provided between the pump (5) and the at least one injector nozzle (3); and characterized in that in a line (20) that leads to the at least one injector nozzle (3) there is at least one valve (21) that shuts off the injector nozzle (3) and that a controllable bypass line (23) branches off upstream of this valve (21) in the direction of flow.

20. Method as recited in claim 19 including said device, said device further comprising one of (NN), (OO), and (PP)

(NN) characterized in that a controllable bypass line (26) branches off in a connecting line between the pump (5) and the device (15) for the heating of the foaming medium;

(OO) characterized in that a controllable bypass line (26) branches off in a connecting line between the pump (5) and the device (15) for the heating of the foaming medium; and characterized in that the at least one injector nozzle (30) is provided on a conveyor line which is formed by at least one conveyor element, such as a transport star wheel, for example, between a filling machine and a closing or capping machine; and (PP) characterized in that a controllable bypass line (26) branches off in a connecting line between the pump (5) and the device (15) for the heating of the foaming medium;

characterized in that the at least one injector nozzle (30) is provided on a conveyor line which is formed by at least one conveyor element, such as a transport star wheel, for example, between a filling machine and a closing or capping machine; and characterized in that the at least one injector nozzle (3) is provided in the outlet star wheel of the filling machine.

* * * * *